US007988342B2

(12) United States Patent
Pahl

(10) Patent No.: US 7,988,342 B2
(45) Date of Patent: Aug. 2, 2011

(54) ADJUSTMENT CLIP FOR A SUSPENDED LIGHT FIXTURE

(75) Inventor: Christopher J. Pahl, Denver, CO (US)

(73) Assignee: Cooper Technologies Company, Houston, TX (US)

( * ) Notice: Subject to any disclaimer, the term of this patent is extended or adjusted under 35 U.S.C. 154(b) by 458 days.

(21) Appl. No.: 11/983,922

(22) Filed: Nov. 13, 2007

(65) Prior Publication Data

US 2008/0112172 A1 May 15, 2008

Related U.S. Application Data

(60) Provisional application No. 60/865,515, filed on Nov. 13, 2006.

(51) Int. Cl.
*F21V 21/00* (2006.01)

(52) U.S. Cl. ..... 362/391; 362/147; 362/217.1; 362/219; 362/220; 362/225; 362/365; 362/366; 362/368; 248/693; 248/74.2; 248/229.16; 248/229.26; 248/231.81; 52/506.05; 52/28; 52/39; 24/457; 24/458

(58) Field of Classification Search ..... 362/147, 362/217.1–217.17, 219, 220, 225, 365, 366, 362/368, 391, 432, 287, 282, 418, 429, 395, 362/404; 248/693, 74.2, 229.16, 229.26, 248/231.81, 342, 343, 344; 24/457, 458, 24/570; 52/506.05, 712, 28, 39
See application file for complete search history.

(56) References Cited

U.S. PATENT DOCUMENTS 3,911,638 A * 10/1975 Englund et al. ..... 52/506.08
3,995,823 A * 12/1976 Hensel ..... 248/327
4,025,019 A * 5/1977 Jacobsen et al. ..... 248/317
4,309,120 A * 1/1982 Werthmann ..... 403/18
4,614,072 A * 9/1986 Price et al. ..... 52/506.08
4,827,687 A * 5/1989 Frawley ..... 52/506.06
5,063,274 A * 11/1991 Johnson ..... 174/158 F
5,482,240 A * 1/1996 Caraher ..... 248/297.51
5,520,610 A * 5/1996 Giglio et al. ..... 600/233
5,550,725 A * 8/1996 Shemitz et al. ..... 362/282
6,022,129 A 2/2000 Tang
6,843,581 B2 * 1/2005 Mier-Langner et al. ..... 362/220
7,153,167 B1 12/2006 Switzer
7,172,332 B2 2/2007 Mobarak et al.
7,178,776 B2 * 2/2007 Buck et al. ..... 248/300
7,282,728 B2 * 10/2007 Culbert ..... 250/504 R
7,316,247 B2 * 1/2008 Thompson ..... 140/102.5
2003/0026094 A1 * 2/2003 Plourde et al. ..... 362/225
2004/0095774 A1 * 5/2004 Haugaard et al. ..... 362/396
2005/0286256 A1 * 12/2005 Tran et al. ..... 362/404
(Continued)

*Primary Examiner* — Ali Alavi
*Assistant Examiner* — Mary Zettl
(74) *Attorney, Agent, or Firm* — King & Spalding LLP

(57) ABSTRACT

Systems and methods for installing row-mounted suspended light fixtures. Each of a row of suspended light fixtures includes brackets disposed on opposite ends of the fixture. Each bracket includes a slot configured to slidably receive an adjustment clip coupled to a support member, such as a ceiling cable or pendant. Each adjustment clip includes first and second segments disposed at a non-zero, acute angle relative to one another such that a space separates the first and second segments. The space is configured to receive a portion of one or more brackets associated with the adjustment clip, proximate the bracket slot(s). An operator can install the light fixtures by positioning a fastener through each adjustment clip, outside the bracket slot(s). He also can adjust an alignment and balance of one or more of the light fixtures by sliding one or more of the adjustment clips along the slot(s) associated therewith.

11 Claims, 5 Drawing Sheets

U.S. PATENT DOCUMENTS

2006/0133077 A1* 6/2006 Roe ..... 362/219
2007/0147053 A1 6/2007 Gagne et al.
2009/0010007 A1* 1/2009 Caluori ..... 362/366
2010/0020549 A1 1/2010 Arceneaux

* cited by examiner

ADJUSTMENT CLIP FOR A SUSPENDED LIGHT FIXTURE

RELATED PATENT APPLICATION

This patent application claims priority under 35 U.S.C. §119 to U.S. Provisional Patent Application No. 60/865,515, entitled "Adjuster Clip," filed Nov. 13, 2006, the complete disclosure of which is hereby fully incorporated herein by reference.

TECHNICAL FIELD

The invention relates generally to suspended light fixtures and more particularly to an adjustment clip for installing row-mounted suspended light fixtures.

BACKGROUND

A suspended light fixture is a light fixture that is suspended from an overhead location, such as a ceiling, by one or more cables or pendants. Suspended light fixtures may be mounted individually or continuously. For example, multiple linear light fixtures may be mounted end-to-end in a "row-mounted" configuration to create a row of modular lighting sections.

Traditionally, each row-mounted, linear light fixture is mounted to the overhead location via one or more cables. A first of the light fixtures is mounted to the overhead location via two cables fastened to opposite ends of the light fixture by a pair of screws. Each end of the first light fixture includes an end bracket with a lateral slot. Each cable is fastened to one of the end brackets by a screw extending through an end of the cable and into the lateral slot of the end bracket. A portion of the screw and a bottom end of the cable, including a cable adjuster mechanism, are disposed within an interior cavity of the first light fixture.

A second of the light fixtures is mounted to the overhead location by tabs extending between a first end of the second light fixture and an end of the first light fixture, and a cable fastened to a second, opposite end of the second light fixture. The cable is fastened to the second end of the second light fixture substantially as described above in connection with each of the cables fastened to the first light fixture. Each additional light fixture in the row of light fixtures is mounted to the overhead location substantially as described above in connection with the second light fixture, with tabs mounting each additional light fixture directly to the light fixture installed immediately prior to the installation of the additional light fixture.

To install the first light fixture, an operator climbs a ladder, aligns each cable with its corresponding end bracket, and tightens the screws. The operator then climbs down the ladder and visually evaluates the alignment and balance of the fixture. If the operator determines that the alignment or balance of the fixture needs to be adjusted, he climbs back up the ladder, loosens one or more of the screws, and laterally moves the cable(s) associated with the loosened screw(s) within the lateral slot(s) of the end bracket(s). For example, the operator can determine to adjust the balance of the fixture if it is not level. Then, the operator re-tightens the screw(s), climbs back down the ladder, and repeats the evaluation and adjustment procedures until the fixture is properly aligned and balanced.

To install the second light fixture, the operator climbs up the ladder with the second light fixture, aligns and connects the tabs between the first and second light fixtures, aligns the cable associated with the second light fixture with its corresponding end bracket, and tightens the screw extending between the cable and the end bracket. The operator then climbs down the ladder and visually evaluates the alignment and balance of the second light fixture. If the operator determines that the alignment or balance of the fixture needs to be adjusted, then he climbs back up the ladder, loosens the screw, and laterally moves the cable within the lateral slot of the end bracket. Then, the operator re-tightens the screw, climbs back down the ladder, and repeats the evaluation and adjustment procedures until the second light fixture is properly aligned and balanced The operator performs these steps for each fixture mounted in a row. Once all the fixtures in the row are mounted, the operator visually evaluates the alignment and balance of the entire row. If the operator determines that the alignment or balance of the row needs to be adjusted, then he can adjust the position of one or more of the fixtures substantially as described above. This process is time-consuming and tedious. The process also involves many inefficiencies, most notably the delay involved in loosening and re-tightening the screws each time the operator adjusts the alignment or balance of a light fixture.

Therefore, a need exists in the art for an improved means for installing suspended light fixtures. In particular, a need exists in the art for efficient, user-friendly systems and methods for installing row-mounted suspended light fixtures. A further need exists in the art for efficient, user-friendly systems and methods for adjusting and balancing the row-mounted suspended light fixtures.

SUMMARY

The invention provides an improved method and device for installing suspended light fixtures. In particular, the invention provides efficient, user-friendly systems and methods for installing row-mounted suspended light fixtures.

Each of a row of suspended light fixtures includes brackets disposed on opposite ends of the fixture. Each bracket includes a slot that can be slidably engaged by an adjustment clip coupled to a support member, such as a ceiling cable or pendant. Each adjustment clip includes first and second segments disposed at a non-zero, acute angle relative to one another such that a space separates opposite ends of the first and second segments. The space is configured to receive a portion of one or more light fixture brackets associated with the adjustment clip, proximate the bracket slot(s). An operator can install the light fixtures by positioning a fastener through each adjustment clip, outside the bracket slot(s), into the support member. The operator also can adjust an alignment and balance of one or more of the light fixtures by sliding one or more of the adjustment clips along the slot(s) associated therewith, without the need to loosen the screw corresponding to the adjustment clips.

These and other aspects, objects, features, and advantages of the invention will become apparent to a person having ordinary skill in the art upon consideration of the following detailed description of illustrated exemplary embodiments, which include the best mode of carrying out the invention as presently perceived.

DETAILED DESCRIPTION OF EXEMPLARY EMBODIMENTS

The invention is directed to systems and methods for installing suspended light fixtures. In particular, the invention is directed to an adjustment clip for installing and adjusting row-mounted suspended light fixtures.

Turning now to the drawings, in which like numerals indicate like elements throughout the figures, exemplary embodiments of the invention are described in detail.

Figure 1:
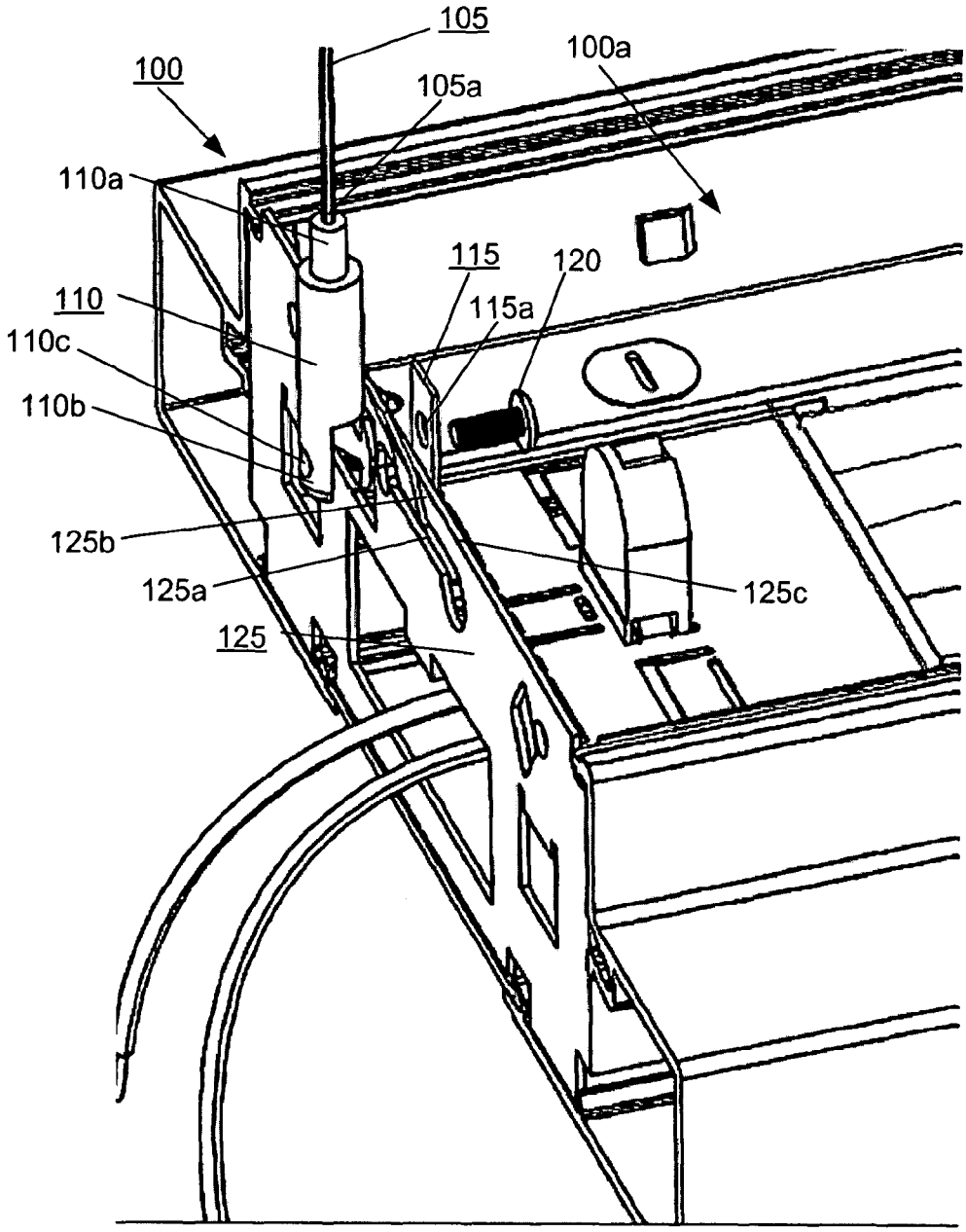
FIG. 1 is an isometric view of a portion of a suspended light fixture, a cable, a cable adjuster, an adjustment clip, and a fastener, according to certain exemplary embodiments.
Figure 2:
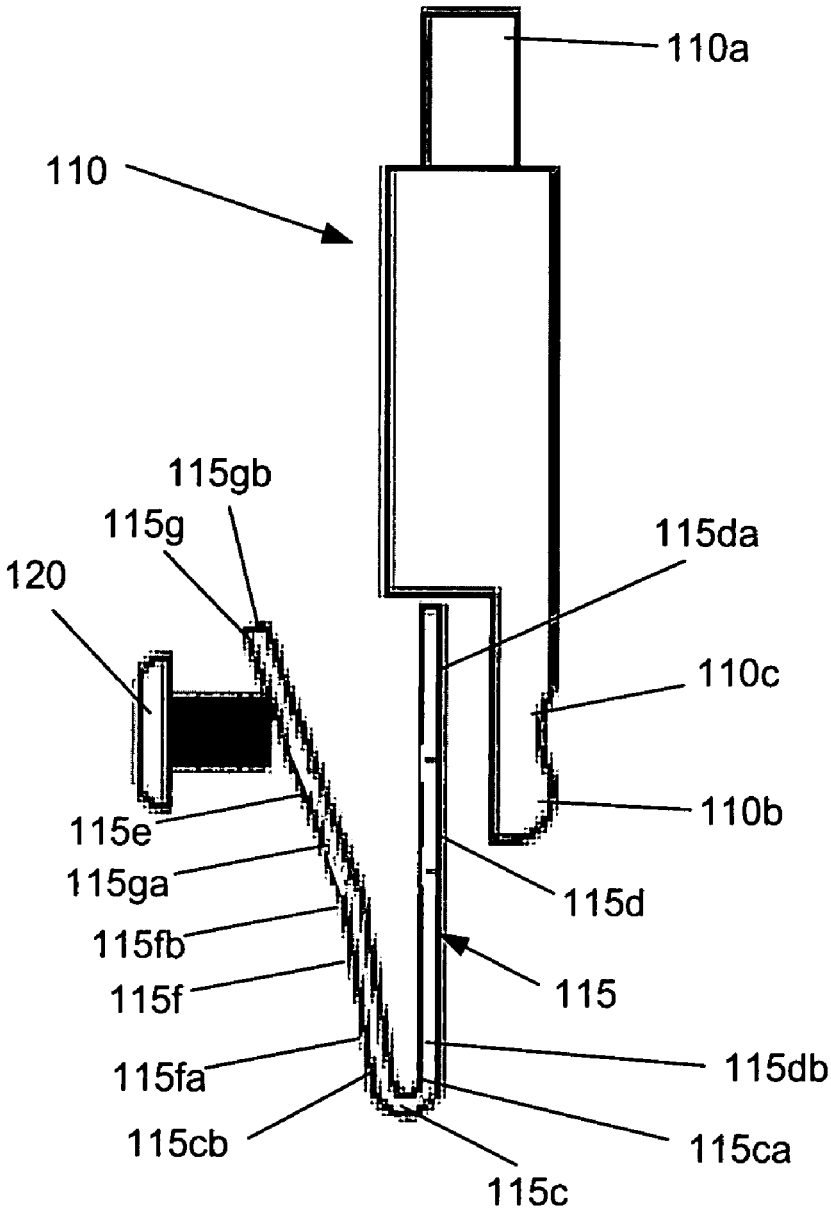
FIG. 2 is a perspective, exploded side view of the exemplary cable adjuster, adjustment clip, and fastener of FIG. 1.
Figure 4:
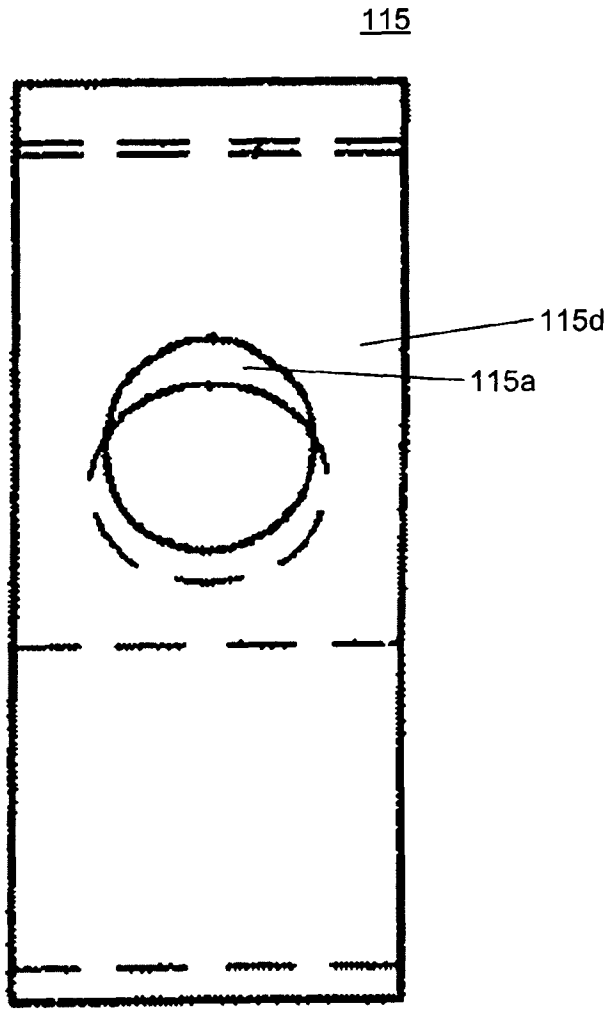
FIG. 4 is a perspective front view of the exemplary adjustment clip of FIG. 1.
Figure 3:
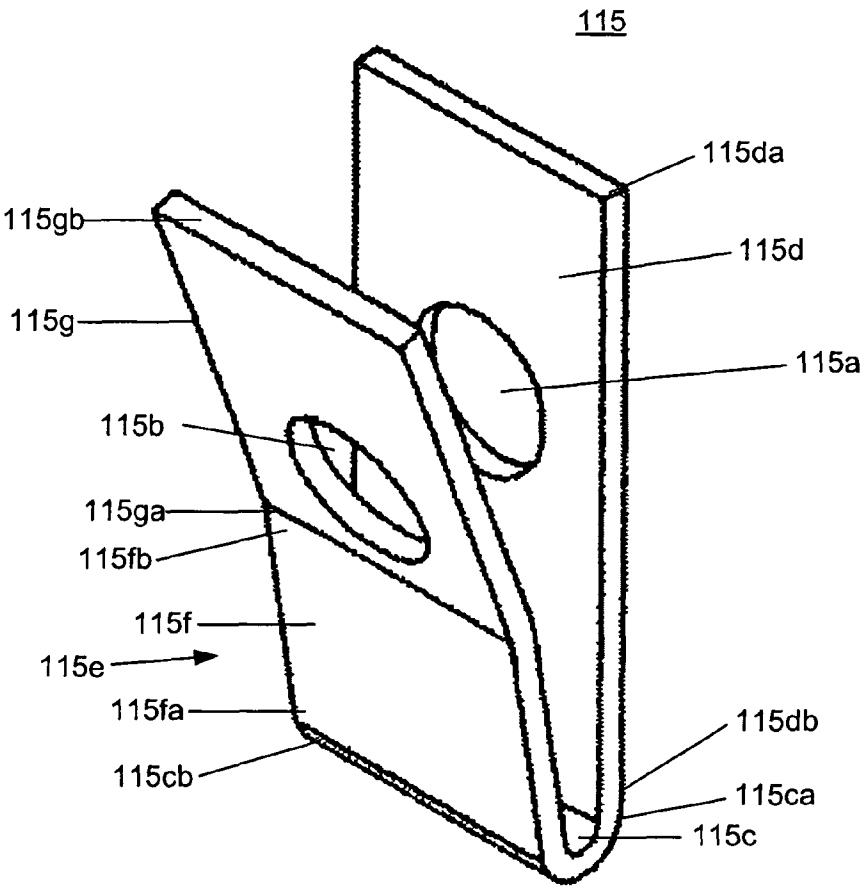
FIG. 3 is an isometric view of the exemplary adjustment clip of FIG. 1.

FIG. 1 is an isometric view of a suspended light fixture 100, cable 105, cable adjuster 110, adjustment clip 115, and fastener 120, according to certain exemplary embodiments. FIG. 2 is a perspective, exploded side view of the exemplary cable adjuster 110, adjustment clip 115, and fastener 120 of FIG. 1. FIGS. 3 and 4 are isometric and perspective front views, respectively, of the exemplary adjustment clip 115 of FIG. 1.

With reference to FIGS. 1-4, the light fixture 100 includes an electrical device configured to create artificial light or illumination. For example, the light fixture 100 can be configured to create such artificial light or illumination via one or more incandescent lamps, fluorescent lamps, and/or light-emitting diodes (not shown) of the light fixture 100.

The light fixture 100 is substantially elongated, with first and second ends disposed on opposite ends of a linear axis of the light fixture 100. Each end of the light fixture 100 includes an end bracket 125, which extends across at least a portion of the light fixture 100, substantially perpendicular to the linear axis thereof. Each end bracket 125 includes a lateral slot 125*a* configured to slidably engage the adjustment clip 115, as described below.

The cable 105 is an elongated member configured to support the weight of at least a portion of the light fixture 100. For example, the cable 105 can include rope, chain, and/or wire, such as wire rope commonly referred to as "aircraft cable." The cable 105 extends from an overhead location, such as a ceiling (not shown), to the light fixture 100 via the cable adjuster 110. In the exemplary embodiment illustrated in FIG. 1, two cables 105 disposed proximate the first and second ends, respectively, of the light fixture 100 are used to suspend the light fixture 100 from the overhead location. However, only one cable 105 is illustrated in FIG. 1.

The cable adjuster 110 is a substantially elongated member configured to couple the light fixture 100 to the cable 105. The cable adjuster 110 includes a top end 110*a* fastened to a bottom end 105*a* of the cable 105, and a bottom end 110*b* configured to be coupled to the adjustment clip 115 via a fastener 120. The fastener 120 can extend through apertures 115*a* and 115*b* of the adjustment clip 115 and an aperture 110*c* in the bottom end 110*b* of the cable adjuster 110 to couple the cable adjuster 110 to the end bracket 125 of the light fixture 100.

In the illustrated exemplary embodiment, the adjustment clip 115 is a substantially "V" shaped member including a base segment 115*c* extending between an engaging segment 115*d* and a receiving segment 115*e*. For example, the adjustment clip 115 can include one or more pieces of plastic and/or metal, such as steel. The engaging segment 115*d* includes a first end 115*da* disposed proximate a bottom edge 110*b* of the cable adjuster 110, and a second end 115*db* disposed proximate a first end 115*ca* of the base segment 115*c*. The receiving segment 115*e* includes a first segment 115*f* having a first end 115*fa* proximate a second end 115*cb* of the base segment 115*c*, and a second segment 115*g* having a first end 115*ga* proximate a second end 115*fb* of the first segment 115*f* of the receiving segment 115*e*. Thus, the first segment 115*f* of the receiving segment 115*e* is disposed between the base segment 115*c* and the second segment 115*g* of the receiving segment 115*e*.

The second segment 115*g* of the receiving segment 115*e* extends angularly from the first segment 115*f* of the receiving segment 115*e*, in a direction away from the engaging segment 115*d*. An axis of the first segment 115*f* of the receiving segment 115*e* forms an acute angle with an axis of the engaging segment 115*d*. Similarly, an axis of the second segment 115*g* of the receiving segment 115*e* forms an acute angle with the axis of the engaging segment 115*d*. The angle formed by the axis of the first segment 115*f* with the axis of the engaging segment 115*d* is less than the angle formed by the axis of the second segment 115*g* with the axis of the engaging segment 115*d*. Thus, the axis of the second segment 115*g* forms an acute angle with an extended axis of the first segment 115*f*. The apertures 115*a* and 115*b* are disposed within the second segment 115*g* of the receiving segment 115*e* and the engaging segment 115*d*, respectively.

In an alternative exemplary embodiment (not illustrated), the second segment 115*g* of the receiving segment 115*e* can be substantially co-linear with the first segment 115*f* of the receiving segment 115*e*. In this embodiment, the receiving segment 115*e* can comprise a single segment.

To install the light fixture 100, an operator can slide a second end 115*gb* of the second segment 115*g* through the lateral slot 125*a* of a first end bracket 125 of the light fixture 100 so that the receiving segment 115*e* and the engaging segment 115*d* are disposed on opposite sides of the end bracket 125. For example, the operator can slide the second end 115*gb* of the second segment 115*g* towards an interior cavity 100*a* of the light fixture 100 so that the receiving segment 115*e* is substantially disposed within the interior cavity 100*a* and the engaging segment 115*d* is disposed on an opposite side of the end bracket 125 from the receiving segment 115*e*, substantially outside the interior cavity 100*a*. Alternatively, the operator can slide the second end 115*gb* of the second segment 115*g* through the lateral slot 125*a* in a direction away from the interior cavity 100*a* of the light fixture 100 so that the receiving segment 115*e* is substantially outside of the interior cavity 100*a* and the engaging segment 115*d* is disposed on an opposite side of the end bracket 125 from the receiving segment 115*e*, substantially inside the interior cavity 100*a*. In either position, a top portion 125*b* of the end bracket 125 rests between the receiving segment 115*e* and the engaging segment 115*d*, substantially on the base segment 115*c*.

In another alternative embodiment, the operator can insert the engaging member 115*d* through the slot either toward the interior cavity 100*a* or away from the interior cavity 100*a*.

After inserting the adjustment clip 115 in the slot 125*a*, the operator can align the aperture 110*c* of the cable adjuster 110 with the apertures 115*a* and 115*b* of the adjustment clip 115. The operator can secure the cable 105 and cable adjuster 110 to the adjustment clip 115 by positioning the fastener 120 within the aligned apertures 110*c*, 115*a*, and 115*b*. Once positioned within the apertures 110*c*, 115*a*, and 115*b*, the fastener 120 is disposed above a top edge 125*c* of the end bracket 125, outside the interior cavity 100*a* of the light fixture 100. The operator can repeat the foregoing steps for the second end bracket 125 on the opposite end of the light fixture 100.

Once the cables 105 and cable are secured to the adjustment clips 115 on both ends of the light fixture 100, the operator can visually inspect the suspended light fixture 100. In particular, the operator can determine whether the light fixture 100 is properly aligned and level. If the operator determines that the light fixture 100 is not properly aligned and/or is not level, then the operator can adjust the alignment and balance of the light fixture 100 by sliding one or both of the adjustment clips 115 within their corresponding end bracket slots 125*a*. For example, the operator can laterally move one of the adjustment clips 115 within its corresponding end bracket slot 125*a* to redistribute weight of the light fixture 100 and, thus, make the light fixture 100 level. Additionally, moving the adjustment clip 115 away from a lateral axis of the light fixture 100 will adjust a height of the light fixture 100 by moving the light fixture 100 closer to the overhead surface.

In certain exemplary embodiments, an interior surface of the bottom segment 115*c* of the adjustment clip 115 can have a contour corresponding to an outer profile of the top portion 125*b* of the end bracket 125. For example, the interior surface of the bottom segment 115*c* of the adjustment clip 115 can have a radius of curvature corresponding to a radius of curvature of the top portion 125*b* of the end bracket 125. The corresponding geometries of the interior surface of the bottom segment 115*c* of the adjustment clip 115 and the top portion 125*b* of the end bracket 125 can allow the adjustment clip 115 to slide more easily along the slot 125*a* of the end bracket 125 during an alignment, height, and/or balance adjustment.

In certain exemplary embodiments, the operator may loosely position the fasteners 120 within the aligned apertures 110*c*, 115*a*, and 115*b* until he is satisfied with the alignment and balance of the light fixture 100. For example, the operator may fully tighten each fastener 120 upon determining that the light fixture 100 is properly aligned and balanced. In certain exemplary embodiments, the tightening of the fastener 120 can cause the second segment 115*g* of the receiving segment 115*e* of the adjustment clip 115 to create a positive contact or crimp against the end bracket 125 of the light fixture 100. For example, the second segment 115*g* may bend towards the end bracket 125 when the fastener 120 is fully tightened.

Although a specific adjustment clip geometry has been described herein, a person of ordinary skill in the art having the benefit of the present disclosure will recognize that other suitable adjustment clip geometries may be used in certain alternative exemplary embodiments. For example, the adjustment clip 115 may have a substantially "U" shaped geometry in certain alternative exemplary embodiments. Alternatively, the adjustment clip 115 may have a "V" shaped geometry with only two conjoined segments. In certain additional alternative exemplary embodiments, one or more of the cables 105 may be replaced with pendants. For example, each cable adjuster 110 may be coupled to a pendant attached to an overhead location, rather than to a cable 105.

Figure 5:
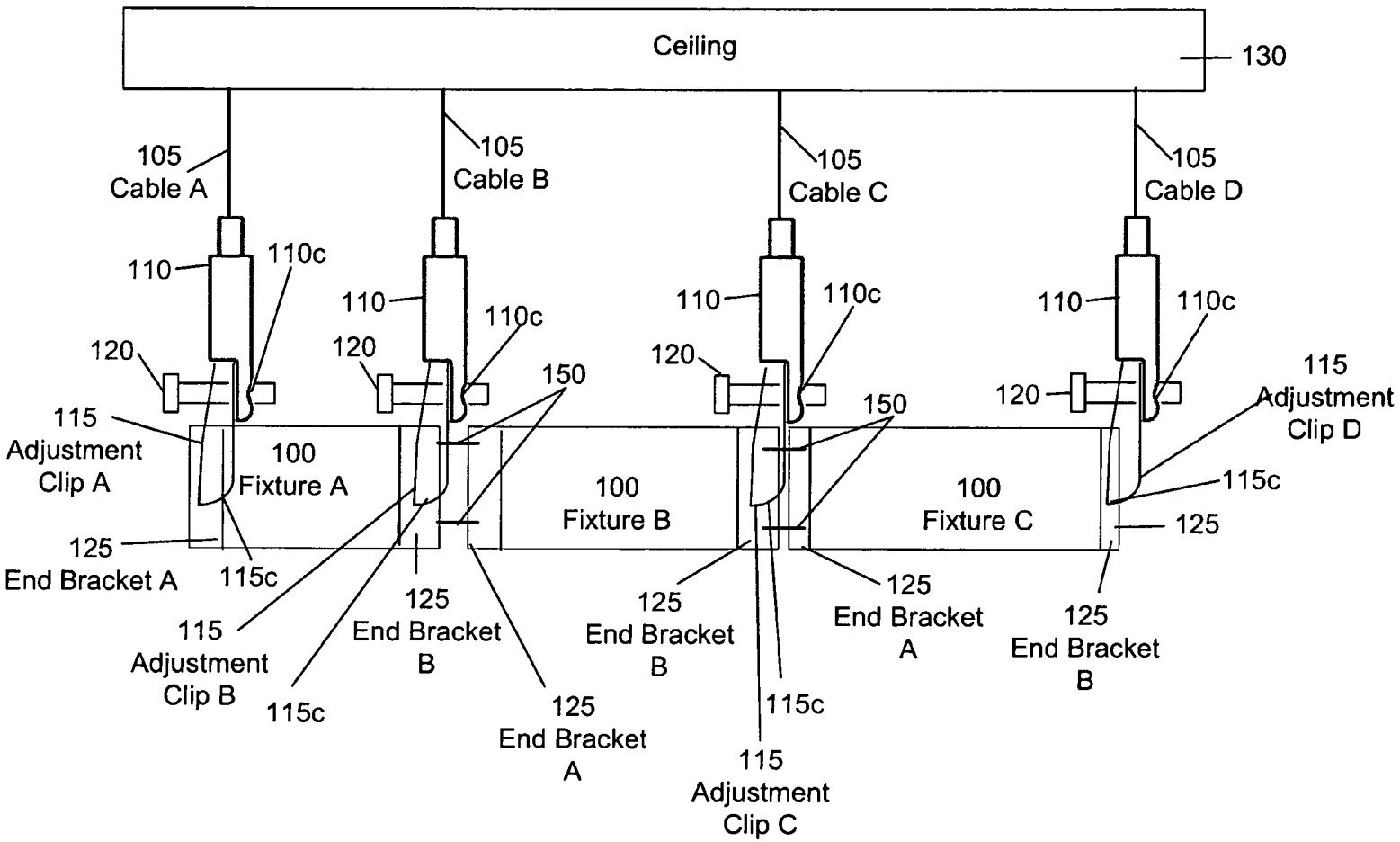
FIG. 5 is a perspective side view of multiple suspended light fixtures mounted to a ceiling via multiple cables, cable adjusters, adjustment clips, and fasteners, according to certain exemplary embodiments.

FIG. 5 is a perspective side view of multiple suspended light fixtures 100 mounted to a ceiling 130 via multiple cables 105, cable adjusters 110, adjustment clips 115, and fasteners 120, according to certain exemplary embodiments. With reference to FIGS. 1-5, the suspended light fixtures 100 are row-mounted, end-to-end, with each cable 105 being disposed proximate a joint between a pair of the light fixtures 100 or proximate an end bracket 125 of a first light fixture (Fixture A) or a last light fixture (Fixture C) in the row. For example, the cables 105 at the ends of the row can be secured to the first and last light fixtures A and C, respectively, substantially as described above with reference to FIGS. 1-4. In certain exemplary embodiments, the light fixtures 100 can be the same or different lengths. For example, each light fixture 100 can be 4 feet long, 8 feet long, or 12 feet long in certain exemplary embodiments.

In certain exemplary embodiments, the cables 105 at the joints of the light fixture pairs also can be secured to the light fixtures 100 as described above. For example, in FIG. 5, once Fixture A is installed as described above, Fixture B can be installed by extending one or more fasteners 150 between end bracket A of Fixture B and end bracket B of Fixture A, and securing cable C to end bracket B of Fixture B, as described above. The fasteners 150 can include any means for securing one object to another object, such as a clasp, tie, snap, hook and eye, buckle, button, closure, tab and notch, etc. For example, each end bracket 125 can include a tab on one end of the end bracket 125 and a notch on another end of the end bracket 125, where each notch and tab is configured to engage a corresponding tab or notch on another end bracket 125.

Once Fixture B is mounted to the ceiling 130 via the fasteners 150 and cable C, the operator can visually inspect Fixture B to determine whether Fixture B is properly aligned and level with Fixture A. If the operator determines that Fixture B is not properly aligned and/or is not level, then the operator can adjust the alignment and balance of Fixture B by sliding adjustment clip C within an end bracket slot 125*a* of end bracket B of Fixture B and/or by sliding one or more of adjustment clip A and adjustment clip B within the end bracket slots 125*a* of their corresponding end brackets A, B. For example, the operator can laterally move one of the adjustment clips 115 within its corresponding end bracket slot 125*a* to redistribute weight of Fixture B and, thus, make Fixture B level.

The operator also can visually inspect the collective alignment and balance of Fixtures A and B. For example, the operator can adjust the alignment and balance of Fixtures A and B by sliding one or more of adjustment clips A, B, C within their corresponding end bracket slots 125*a*. In certain exemplary embodiments, each time the operator adds another light fixture to the row, the operator can perform the adjustment and balancing procedure for the light fixture and the row.

Once Fixture B is installed, Fixture C an be installed by extending one or more additional fasteners 150 between end bracket B of Fixture B and end bracket A of Fixture C, and securing cable D to end bracket B of Fixture C, as described above.

Figure 6:
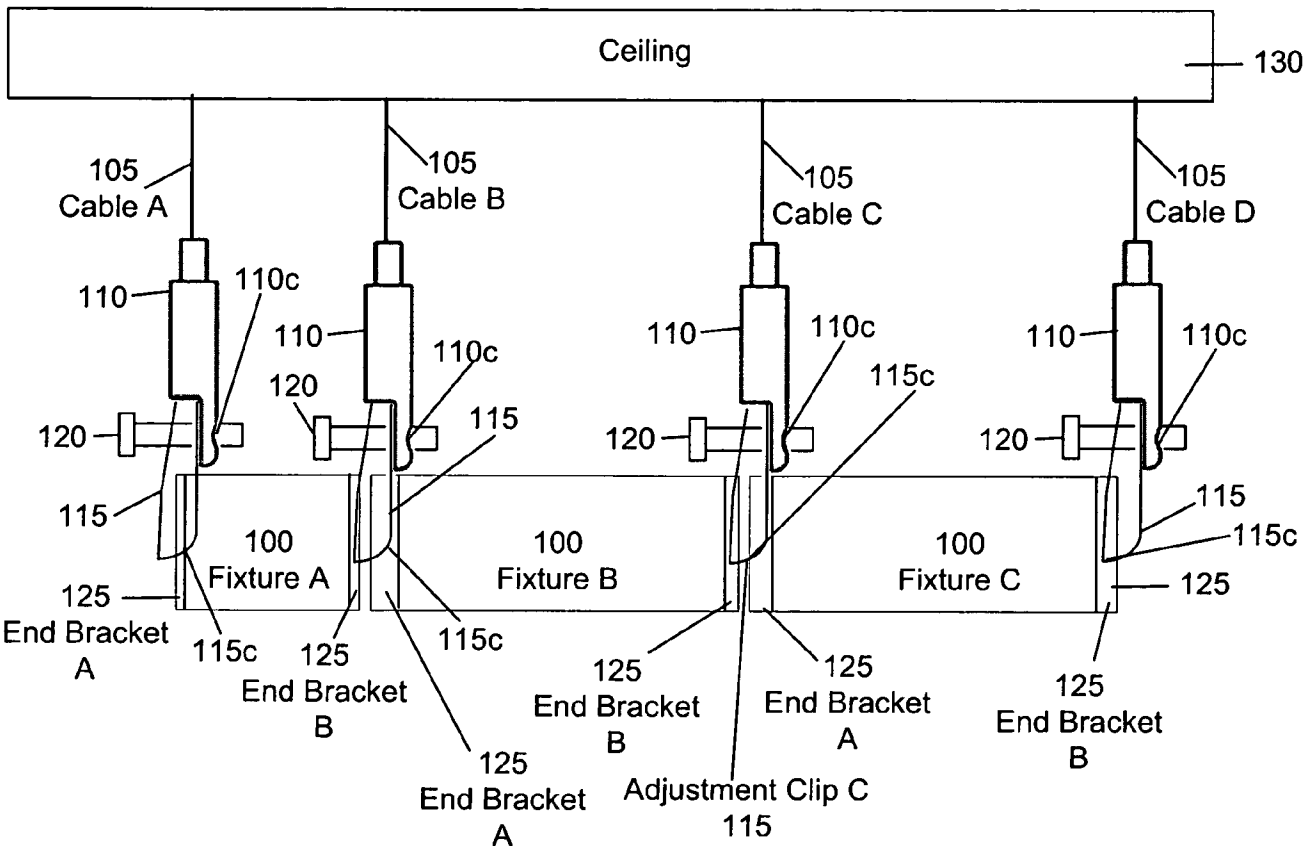
FIG. 6 is a perspective side view of multiple suspended light fixtures mounted to a ceiling via multiple cables, cable adjusters, adjustment clips, and fasteners, according to certain alternative exemplary embodiments.

FIG. 6 is a perspective side view of multiple suspended light fixtures 100 mounted to a ceiling 130 via multiple cables 105, cable adjusters 110, adjustment clips 115, and fasteners 120, according to certain alternative exemplary embodiments. With reference to FIGS. 1-6, the suspended light fixtures 100 are row-mounted, end-to-end, with each cable 105 being coupled to a joint between a pair of the light fixtures 100 or to an end bracket 125 of a first light fixture (Fixture A) or a last light fixture (Fixture C) in the row. For example, the cables 105 at the ends of the row can be secured to the first and last light fixtures A and C, respectively, substantially as described above with reference to FIGS. 1-5. In certain exemplary embodiments, the light fixtures 100 can be the same or different lengths. For example, each light fixture 100 can be 4 feet long, 8 feet long, or 12 feet long in certain exemplary embodiments.

The cables 105 at the joints of the light fixture pairs are secured to the light fixtures 100 as described above, except that, for each pair of light fixtures 100, the adjustment clip 115 extends through two end brackets 125 rather than one. Specifically, the adjustment clip 115 extends through the lateral slots 125*a* of the end brackets 125 of each light fixture 100 proximate the joint. For example, in FIG. 6, a single adjustment clip 115 can extend through lateral slots on end bracket A of fixture C and end bracket B of fixture B. The base segment 115*c* of each adjustment clip 115 is sized to accommodate both end brackets 125.

To install the light fixtures 100, an operator can secure cable A to end bracket A of fixture A substantially as described above with reference to FIGS. 1-4. Then, the operator can secure cable B to end bracket B of fixture A and end bracket A of fixture B using a single adjustment clip 115. For example, the operator can insert the second end 115*gb* of the second segment 115*g* of the receiving segment 115*e* of the adjustment clip 115 through the lateral slots 125*a* of both end brackets 125 so that the receiving segment 115*e* and the engaging segment 115*d* are separated by the end brackets 125 of fixtures A and B. For example, the operator can insert the second end 115*gb* of the second segment 115*g* through the slot 125*a* of fixture B away from the interior cavity 100*a* of fixture B and through the slot 125*a* of fixture A towards the interior cavity 100*a* of fixture A so that the receiving segment 115*e* is substantially disposed within the interior cavity 100*a* of fixture A and the engaging segment 115*d* is substantially disposed within the interior cavity 100*a* of fixture B.

Alternatively, the operator can insert the second end 115*gb* of the second segment 115*g* through the slot 125*a* of fixture A away from the interior cavity 100*a* of fixture A and through the slot 125*a* of fixture B towards the interior cavity 100*a* of fixture B so that the receiving segment 115*e* is substantially disposed within the interior cavity 100*a* of fixture B and the engaging segment 115*d* is substantially disposed within the interior cavity 100*a* of fixture A. In other alternative exemplary embodiments, the operator can insert either the engaging member 115*d* of the receiving member 115*e* through the slot 125*a* of fixture A and can insert the other member through the slot 125*a* of fixture B. In any case, the top portions 125*b* of both end bracket B of fixture A and end bracket A of fixture B rests between the receiving segment 115*e* and the engaging segment 115*d*, substantially on the base segment 115*c*.

Then, the operator can align the aperture 110*c* of the cable adjuster 110 with the apertures 115*a* and 115*b* of the adjustment clip 115. The operator can secure the cable 105 and cable adjuster 110 to the adjustment clip 115 by positioning the fastener 120 within the aligned apertures 110*c*, 115*a*, and 115*b*. Once positioned within the apertures 110*c*, 115*a*, and 115*b*, the fastener 120 is disposed above a top edge 125*c* of the end bracket 125. The operator can repeat the foregoing steps for the remaining cables 105 to secure all of the light fixtures 100 to the ceiling 130.

Then, the operator can visually inspect the suspended light fixtures 100. In particular, the operator can determine whether the light fixtures 100 are properly aligned and level. If the operator determines that any of the light fixtures 100 is not properly aligned and/or is not level, then the operator can adjust the alignment and balance of the light fixture 100 by sliding one or both of the adjustment clips 115 associated with the light fixture 100 within their corresponding end bracket slots 125*a*. For example, the operator can laterally move one of the adjustment clips 115 within its corresponding end bracket slot 125*a* to redistribute weight of the light fixture 100 and, thus, make the light fixture 100 level.

The operator also can visually inspect the collective alignment and balance of the entire row of light fixtures 100. For example, the operator can adjust the alignment and balance of the row by sliding one or more of the adjustment clips 115 in the row within their corresponding end bracket slots 125*a*. In certain exemplary embodiments, each time the operator adds another light fixture to the row, the operator can perform the adjustment and balancing procedure for the light fixture and the row.

In certain exemplary embodiments, an interior surface of the bottom segment 115*c* of the adjustment clip 115 can have a contour corresponding to the outer profiles of the top portions 125*b* of the end brackets 125 associated therewith. For example, the interior surface of the bottom segment 115*c* of the adjustment clip 115 can have a radius of curvature corresponding to a radius of curvature of the top portions 125*b* of the end brackets 125. The corresponding geometries of the interior surface of the bottom segment 115*c* of the adjustment clip 115 and the top portions 125*b* of the end brackets 125 can allow the adjustment clip 115 to slide more easily along the slots 125*a* of the end brackets 125 during an alignment and/or balance adjustment.

In certain exemplary embodiments, the operator may loosely position the fasteners 120 within the aligned apertures 110*c*, 115*a*, and 115*b* until he is satisfied with the alignment and balance of each light fixture 100 and/or a combination of light fixtures 100 in the row. For example, the operator may fully tighten each fastener 120 upon determining that each light fixture 100 and/or the combination of the light fixtures 100 is properly aligned and balanced.

In certain alternative exemplary embodiments, one or more of the cables 105 may be replaced with pendants. For example, each cable adjuster 110 may be coupled to a pendant attached to an overhead location, rather than to a cable 105.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person having ordinary skill in the art without departing from the spirit and scope of the present invention defined in the following claims, the scope of which is to be accorded the broadest interpretation so as to encompass such modifications and equivalent structures.

What is claimed is:

1. A system for installing a suspended light fixture, comprising:

a suspended light fixture having a first end and a second end disposed opposite the first end, each of the first end and the second end comprising an end bracket comprising an elongated slot;

first and second clips, each of the first and second clips extending through the elongated slot of a corresponding one of the end brackets, each one of the first and second clips comprising a first segment having a first end and a second end disposed opposite the first end of the first segment, the first segment comprising a first aperture, a second segment having a first end and a second end disposed opposite the first end of the second segment, the second segment comprising a second aperture, and a third segment extending between the second end of the first segment and the second end of the second segment, wherein the first segment, second segment, and third segment define a channel within which at least a portion of the end bracket associated with the one of the first and second clips is received when the one of the first and second clips extends through the elongated slot, the received portion of the end bracket resting on the third segment, when the suspended light fixture is suspended; and first and second fasteners, each of the first and second fasteners extending through the first and second apertures in a respective one of the first and second clips, thereby coupling the first and second clips to respective support members, which suspend the suspended light fixture from the over-head surface.

2. The system of claim 1, wherein the first and second fasteners are disposed, in their entireties, outside of their associated end brackets when the first and second fasteners extend through their respective first and second apertures.

3. The system of claim 1, wherein for at least one of the first and second clips, the channel is configured to receive both the at least a portion of the end bracket associated with the one of the first and second clips and at least a portion of another end bracket associated with another light fixture.

4. The system of claim 1, wherein, when the suspended light fixture is installed, the third segment bears weight from the at least a portion of the end bracket.

5. The system of claim 4, wherein after the light fixture is installed, each of the clips is slidable along the elongated slot through which it extends.

6. The system of claim 1, wherein for each one of the first and second clips, the third segment comprises an interior surface having a contour corresponding to an outer profile of the at least a portion of the end bracket associated with the one of the first and second clips.

7. The system of claim 1, wherein, for at least one of the first and second clips, the first segment comprises a straight member, and the second segment comprises an angled member comprising:

a first portion having a first end and a second end, the first end of the first portion adjacent the third segment and defining the second end of the second segment, and a second portion extending from the second end of the first portion and defining the first end of the second segment, a plane extending through the first end and second end of the second portion angled with respect to a plane extending through the first end and second end of the first portion.

8. The system of claim 7, wherein the second portion extends angularly from the first portion, in a direction away from the first segment.

9. The method of claim 1, wherein, for each of the first and second clips, after the suspended light fixture is installed, the third segment of the clip extends through the elongated slot of the corresponding end bracket, and the first end of the first segment of the clip and the first end of the second segment of the clip are disposed on opposite sides of the elongated slot of the corresponding end bracket.

10. A method for installing a suspended light fixture, comprising:

providing a light fixture having a first end and a second end disposed opposite the first end, each of the first end and the second end comprising an end bracket comprising an elongated slot;

providing an elongated support member extending from an over-head surface;

sliding a clip through the end bracket of one of the first end of the light fixture and the second end of the light fixture, the clip comprising:

a first segment having a first end and a second end disposed opposite the first end of the first segment, the first segment comprising an aperture, a second segment having a first end and a second end disposed opposite the first end of the second segment, the second segment comprising an aperture, and a third segment extending between the second end of the first segment and the second end of the second segment, wherein the first segment, second segment, and third segment define a channel within which at least a portion of the end bracket of the one of the first and second clips is received upon sliding the clip through the end bracket, the received portion of the end bracket resting on the third segment, when the suspended light fixture is suspended; and suspending the end bracket from the over-head surface by positioning a fastener through each of an aperture in the elongated support member, the aperture in the first segment of the clip, and the aperture in the second segment of the clip, the positioned fastener disposed completely outside of the end bracket.

11. The method of claim 10, wherein the step of sliding the clip through the end bracket comprises sliding the clip through an elongated slot in the end bracket, and wherein the method further comprises the step of adjusting a position of the suspended light fixture after the end bracket is coupled to the over-head surface, by sliding the clip along an elongated slot in the end bracket.

* * * * *